US005104766A

United States Patent [19]

Nakano et al.

[11] Patent Number: 5,104,766

[45] Date of Patent: Apr. 14, 1992

[54] TONER FOR DEVELOPING STATICALLY CHARGED IMAGES AND PROCESS FOR PREPARATION THEREOF

[75] Inventors: Tetsuya Nakano, Nabari; Naruo Yabe, Kobe; Masahide Inoue, Nara; Koichi Tsuyama, Kobe; Yoshitake Shimizu, Kyoto; Mitsushi Kuroki, Kumamoto, all of Japan

[73] Assignee: Mita Industrial Co., Ltd., Osaka, Japan

[21] Appl. No.: 544,637

[22] Filed: Jun. 27, 1990

[30] Foreign Application Priority Data

Jun. 29, 1989 [JP] Japan ..... 1-165347

[51] Int. Cl.[5] ..... G03G 9/097

[52] U.S. Cl. ..... 430/137; 430/110; 430/111

[58] Field of Search ..... 430/110, 111, 137

[56] References Cited

U.S. PATENT DOCUMENTS 3,876,610 4/1975 Timmerman et al. ..... 430/111 X
4,737,433 4/1988 Rimai et al. ..... 430/111
4,816,365 3/1989 Ishikawa ..... 430/111
4,826,747 5/1989 Chiba et al. ..... 430/111 X
4,957,840 9/1990 Sakashita et al. ..... 430/111 X
4,996,126 2/1991 Anno et al. ..... 430/111 X

FOREIGN PATENT DOCUMENTS 101328 8/1979 Japan ..... 430/111

*Primary Examiner*—Roland Martin
*Attorney, Agent, or Firm*—Sherman and Shalloway

[57] ABSTRACT

Disclosed are a toner for developing a statically charged image and a process for the preparation thereof. If a toner for developing a statically charged image, comprising a binder resin and, dispersed therein, a colorant and a charge-controlling dye, is prepared so that it has a particle size distribution satisfying the requirement represented by the following formula:

$$N < -172.7C + 1.45 \quad (1)$$

wherein N represents the number (%) of particles having a particle size larger than 16 μm, as measured by Coulter Counter, and C represents the surface dye concentration (g/g) of toner particles, a copy having a high image density with a drastically reduced visible fogging can be obtained.

1 Claim, No Drawings

TONER FOR DEVELOPING STATICALLY CHARGED IMAGES AND PROCESS FOR PREPARATION THEREOF

Background of the Invention

1. Field of the Invention

The present invention relates to a toner for developing statically charged images in the electrophotography, and a process for the preparation thereof. More particularly, the present invention relates to a toner for developing a statically charged image, which can drastically reduce the visible fogging, and a process for the preparation thereof.

2. Description of the Related Art

In the field of the electrophotography, an image is formed by developing a statically charged image formed on the surface of a photosensitive material with a charged toner, the formed toner image is transferred on a transfer material and the toner image is then fixed. At this formation of the image, it is required that the optical density of the image area should be high and the adhesion of the toner to the background area, that is, the fogging, should be controlled.

Japanese Unexamined Patent Publication No. 61-36757 proposes a two-component type magnetic developer comprising a ferrite carrier and an electroscopic toner, wherein the electroscopic toner is a toner having a surface dye concentration of $4.0\times10^{-3}$ to $9.0\times10^{-3}$ g/g of the toner. It is taught that in this developer, the allowable range of the toner concentration is broad, the frictional chargeability is good, fogging or formation of brush marks is hardly caused and an excellent image is obtained.

In the electrophotography, the fogging has been evaluated by calculating the fogging density from the difference between the reflection density of the background of the obtained copy and the reflection density before the copying operation.

However, in the case where the fogging density is low, the optically determined fogging density is not well in conformity with the fogging density visually detected, and it often happens that even if the optically determined fogging density is low, the visible fogging is generated.

SUMMARY OF THE INVENTION

Although the above-mentioned prior technique is significant in that the relation between the surface dye concentration in the toner and the fogging density has been clarified, we have found that generation of the visible fogging is seriously influenced not only by the surface dye concentration but also the particle size distribution of the toner.

It is therefore a primary object of the present invention to provide a toner for developing a statically charged image, which can give a high-density copy having the drastically reduced visible fogging, and a process for the preparation thereof.

More specifically, in accordance with one fundamental aspect of the present invention, there is provided a toner for developing a statically charged image, which comprises a binder resin and, dispersed therein, a colorant and a charge-controlling dye, wherein the toner has a particle size distribution satisfying the requirement represented by the following formula:

$$N < -172.7C + 1.45 \quad (1)$$

wherein N represents the number (%) of particles having a particle size larger than 16 μm, as measured by Coulter Counter, and C represents the surface dye concentration (g/g) of toner particles.

It is preferred that the surface dye concentration C of toner particles in the above formula (1) be $2\times10^{-3}$ to $7\times10^{-3}$ g/g.

In accordance with another aspect of the present invention, there is provided a process for the preparation of a toner for developing a statically charged image, which comprises a binder resin and, dispersed therein, a colorant and a charge-controlling dye, said process being characterized in that the toner is prepared so that it has a particle size distribution satisfying the requirement represented by the following formula:

$$N < -172.7C + 1.45 \quad (1)$$

wherein N represents the number (%) of particles having a particle size larger than 16 μm, as measured by Coulter Counter, and C represents the surface dye concentration (g/g) of toner particles.

DETAILED DESCRIPTION OF THE PREFERRED EMBODIMENTS

The present invention is based on the finding that if the particle size distribution of the toner is controlled relatively to the surface dye concentration C of the toner particles so that the requirement represented by the above formula (1) is satisfied, the problem of generation of the visible fogging can be solved. The formula (1) is the empirical formula derived from the results of various experiments where generation of the visible fogging was examined while changing the particle size distribution of the toner and the surface dye concentration of toner particles. So far as the number N (%) of particles having a particle size larger than 16 μm, as measured by Coulter Counter, satisfies the requirement of the formula (1), generation of the visible fogging can be obviated. Namely, as the surface dye concentration C is low, generation of the visible fogging is reduced, but also the number N (%) of toner particles having a particles size larger than 16 μm has important influences on generation of the visible fogging, and the allowable upper limit value of N is 1.45% by number, but as the surface dye concentration C increases, this allowable value becomes small in inverse proportion to the surface dye concentration.

The reason why the number N (%) of particles having a particle size larger than 16 μm is especially taken into account in the present invention is as follows. Namely, with respect to the background of a copy (before the fixation), we determined the histogram of the particle sizes of adhering particles by using an image analyzer (Quantimet 900), and we examined the relation between this particle size distribution and the visible fogging. As the result, it was confirmed that if toner particles having a particle size larger than 16 μm are present, the visible fogging is observed.

In the instant specification and appended claims, by the surface dye concentration (g/g) is meant the value obtained, as described in the example given hereinafter, by selectively extracting only the dye present on surfaces of toner particles, calculating the dye concentration from the extinction coefficient of the obtained extract and converting the calculated dye concentration to the amount of the dye per gram of the toner particles.

Detailed conditions of the present invention will now be described.

The electroscopic toner used in the present invention has electroscopic, coloring and fixing properties, and the electroscopic toner comprises a binder resin, a coloring pigment and a charge-controlling agent as indispensable components.

As the binder resin, there can be used thermoplastic resin, uncured thermosetting resin and precondensates thereof. As suitable examples, there can be mentioned, in order of the importance, vinyl aromatic resins such as polystyrene, acrylic resins, polyvinyl acetal resins, polyester resins, epoxy resins, phenolic resins, petroleum resins and olefin resins. As the coloring pigment, there can be used at least one member selected from the group consisting of carbon black, cadmium yellow, molybdenum orange, Pyrazolone Red, Fast Violet B and Phthalocyanine Blue.

Known charge-controlling dyes can be optionally used. For example, the following charge-controlling dyes can be used, though charge-controlling agents that can be used in the present invention are not limited to those exemplified below.

As the positive charge-controlling agent, there can be mentioned C.I. Solvent Black 1, C.I. Solvent Black 2, C.I. Solvent Black 3, C.I. Solvent Black 5 and C.I. Solvent Black 7.

As the negative charge-controlling agent, there are preferably used alcohol-soluble complex salt azo dyes containing chromium, iron or cobalt. A 2:1 metal complex salt dye represented by the following formula is especially preferably used as the complex salt dye:

[Y]

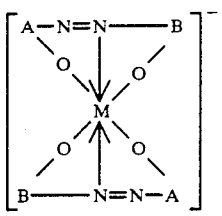

wherein A represents a residue of a diazo component having a phenolic hydroxyl group at the orthoposition, B represents a residue of a coupling component, M represents chromium, iron or cobalt, and [Y], represents an inorganic or organic cation. Furthermore, a sulfonylamine derivative of copper phthalocyanine can be used for attaining the object of the present invention.

As typical examples of the metal-containing complex salt dye, there can be mentioned a chromium-containing metal complex dye of C.I. Acid Black 123, C.I. Solvent Black 22, C.I. Solvent Black 23, C.I. Solvent Black 28, C.I. Solvent Black 42 and Solvent Black 43. Moreover, metal complexes of salicylic acid and alkyl salicylates can be used as the negative charge-controlling agent.

The amount of the binder resin in the toner is preferably 80 to 96% by weight and especially preferably 85 to 93% by weight based on the entire toner, the amount of the pigment is preferably 3 to 10% by weight and especially preferably 3.5 to 8% by weight based on the entire toner, and the amount of the dye is preferably 0.7 to 4% by weight and especially preferably 1 to 2% by weight based on the entire toner.

In view of the chargeability of the toner and in order to prevent generation of the visible fogging, it is preferred that the surface dye concentration be $2\times10^{-3}$ to $7\times10^{-3}$ g/g, especially $3\times10^{-3}$ to $6\times10^{-3}$ g/g.

In order to maintain the surface dye concentration of the toner at a low level as mentioned above, it is preferred that the respective components such as a resin powder, a colorant and a charge-controlling dye be sufficiently mixed by a mixer in which a shearing force is imposed, for example, a Henschel mixer, a super mixer or a ball mill. The obtained dry blend is melt-kneaded by a twin-screw extruder, a three-roll mill or a kneader, and the kneaded composition is cooled, pulverized and classified.

Such methods as (i) a method in which a fraction having a particle size larger than 16 μm is cut from the pulverized toner by sieving, and (ii) a method in which pulverization is carried out so that the maximum distribution particle size is shifted to a small particle size side and the content of the fraction having a particle size larger than 16 μm is reduced, can be adopted singly or in combination.

The toner of the present invention is mixed with a known magnetic carrier such as a sintered ferrite particle carrier or an iron carrier, and is used in the form of a two-component developer for developing a statically charged image. The toner concentration is preferably 2 to 15% by weight.

This two-component developer is advantageously used in the form of a magnetic brush for developing a positively charged image, for example, a statically charged image on a selenium type photosensitive material.

According to the present invention, by setting the particle size distribution of the toner relatively to the surface dye concentration of the toner so that the requirement represented by the above-mentioned formula (1) is satisfied, generation of the visible fogging can be effectively controlled.

The present invention will now be described in detail with reference to the following example that by no means limits the scope of the invention.

EXAMPLE 1

To 100 parts by weight of a styrene/acrylic copolymer as the binder resin were added 10 parts by weight of carbon black as the colorant and 1.5 parts by weight of Spilon Black TRH (supplied by Hodogaya Kagaku Kogyo) or Bontron S-34 (supplied by Orient Kagaku) as the azo type chromium complex compound as the charge-controlling agent or Bontron E-84 (supplied by Orient Kagaku) as the salicylic acid type zinc complex as the charge-controlling agent, and the composition was mixed for a mixing time adjusted to 3 to 40 minutes by a Henschel mixer. According to customary procedures, the dry blend was melt-kneaded and the kneaded blend was cooled, pulverized and classified. Thus, 12 toners shown in Table 1 were prepared.

With respect to each of the obtained toners, the surface dye concentration was determined according to the following method.

To precisely weighed 100 mg of the toner was added 50 ml of methanol, and the mixture was treated for 10 minutes by a ball mill and allowed to stand still for 1 day. The dye concentration of the supernatant was measured by an absorptiometer, and the concentration was calculated according to Lambert-Beer's law.

A copy sample was obtained by an electrophotographic copying machine (Model DC-2055 supplied by Mita Kogyo), and the degree of the visible fogging was measured by an image analyzer. The obtained results are shown in Table 1.

TABLE 1

| Toner | Charge-Controlling Agent | Surface Dye Concentration C (g/g) | $-172.7C + 1.45$ | Number N (%) of Particles Having Particle Size Larger than 16 μm | Visible Fogging* |
|---|---|---|---|---|---|
| A | Bontron S-34 | 0.0060 | 0.415 | 0.365 | ○ |
| B | Bontron E-84 | 0.0060 | 0.415 | 0.453 | X |
| C | Spilon Black TRH | 0.0055 | 0.501 | 0.520 | X |
| D | Bontron S-34 | 0.0052 | 0.552 | 0.432 | ○ |
| E | Bontron E-84 | 0.0050 | 0.587 | 0.392 | ○ |
| F | Spilon Black TRH | 0.0050 | 0.587 | 0.438 | ○ |
| G | Bontron E-84 | 0.0047 | 0.638 | 0.541 | ○ |
| H | Bontron S-34 | 0.0047 | 0.638 | 0.644 | X |
| I | Spilon Black TRH | 0.0047 | 0.638 | 0.655 | X |
| J | Bontron E-84 | 0.0039 | 0.776 | 0.752 | ○ |
| K | Bontron S-34 | 0.0032 | 0.897 | 0.711 | ○ |
| L | Bontron E-84 | 0.0032 | 0.897 | 0.903 | X |

Note
○: not observed
X: observed

From the results shown in Table 1, it is seen that by controlling the content of particles having a particle size larger than 16 μm relatively to the surface dye concentration, generation of the visible fogging can be prevented.

We claim:

1. In a process for preparing a toner useful in a two-component magnetic developer by melting and kneading a binder resin, a colorant and a charge-controlling dye after dry blending the same, and pulverizing and sifting the kneaded composition thereby obtained after cooling same, the improvement which comprises carrying out the dry blending, melting and kneading, and pulverizing steps under conditions which control the surface dye concentration (g/g) of the resulting toner particles to the range of $2\times10^{-3}$ to $7\times10^{-7}$ g/g, and performing the sifting step so as to obtain a particle size distribution of the toner particles, which satisfies the following relationship:

$$N < -172.7C + 1.45$$

wherein N represents the number (%) of particles having a particle size larger than 16 μm, as measured by a Coulter Counter, and C represents the surface dye concentration (g/g) of the toner particles.

* * * * *